US009874032B1

(12) United States Patent
Chen

(10) Patent No.: US 9,874,032 B1
(45) Date of Patent: Jan. 23, 2018

(54) TILE LEVELING STRUCTURE

(71) Applicant: PLUS CRAFT INDUSTRIAL CO., LTD., Taichung (TW)

(72) Inventor: Timmy Chen, Taichung (TW)

(73) Assignee: Plus Craft Industrial Co., Ltd., Taichung (TW)

( * ) Notice: Subject to any disclaimer, the term of this patent is extended or adjusted under 35 U.S.C. 154(b) by 24 days.

(21) Appl. No.: 15/270,040

(22) Filed: Sep. 20, 2016

(51) Int. Cl.
*E04F 21/00* (2006.01)
*E04F 21/20* (2006.01)

(52) U.S. Cl.
CPC ..... *E04F 21/20* (2013.01)

(58) Field of Classification Search
CPC ... E04F 21/0092; E04F 21/22; E04F 13/0892; E04F 15/02022; E04F 21/1838; E04F 21/185
See application file for complete search history.

(56) References Cited

U.S. PATENT DOCUMENTS 7,954,300 B1 * 6/2011 Kufner ..... E04F 21/0092 33/526
8,079,199 B1 * 12/2011 Kufner ..... E04F 13/0892 33/526
8,429,878 B1 * 4/2013 Hoffman ..... E04F 13/0889 52/747.11
8,429,879 B1 * 4/2013 Hoffman ..... E04F 21/0092 52/747.11
2010/0287868 A1 * 11/2010 Kufner ..... E04F 21/0092 52/391
2013/0255182 A1 * 10/2013 Kufner ..... E04F 21/22 52/749.11
2014/0283401 A1 * 9/2014 Kufner ..... E04F 21/0092 33/527
2015/0211243 A1 * 7/2015 Irvine ..... E04F 21/0092 52/126.1
2015/0240504 A1 * 8/2015 Hoffman ..... E04F 21/20 29/244

* cited by examiner

*Primary Examiner* — Gisele Ford
(74) *Attorney, Agent, or Firm* — Alan D. Kamrath; Kamrath IP Lawfirm, P.A.

(57) ABSTRACT

A tile leveling structure includes a fixture and a leveling member mounted on the fixture. The fixture includes a base, an adjusting plate extending upward from the base, and a oneway toothed rack mounted on the adjusting plate. The base and the adjusting plate have a connection formed with a breaking point. The leveling member is provided with a passage through which the adjusting plate passes. The leveling member has a bottom provided with a pressing face is provided with a first locking portion and a second locking portion. The leveling member is provided with a first wing and a second wing. The first wing is provided with a first hook which is provided with a first abutting face. The second wing is provided with a second hook which is provided with a second abutting face.

5 Claims, 10 Drawing Sheets

TILE LEVELING STRUCTURE

BACKGROUND OF THE INVENTION

1. Field of the Invention

The present invention relates to a leveling structure and, more particularly, to a tile leveling structure.

2. Description of the Related Art

A conventional tile leveling structure in accordance with the prior art shown in FIGS. 1 and 2 comprises a base 10, an adjusting plate 11 integrally formed on and extending upward from the base 10, a oneway toothed rack 13 mounted on the adjusting plate 11 and located adjacent to the top end 12 of the adjusting plate 11, and a leveling member 20 movably mounted on the adjusting plate 11. The base 10 and the adjusting plate 11 have a connection formed with a breaking point 14. The adjusting plate 11 is made of plastic material with resilience and flexibility. The leveling member 20 has a hollow inside and has an upper end provided with an operation face 21 and a lower end provided with an abutting face 22. The operation face 21 of the leveling member 20 is provided with a through hole 23 allowing passage of the adjusting plate 11, with the top end 12 of the adjusting plate 11 protruding outward from the through hole 23 of the operation face 21. The through hole 23 of the operation face 21 has two sides each provided with a oneway ratchet toothed portion 24 meshing with the oneway toothed rack 13 of the adjusting plate 11.

In operation, cement is applied on the ground. Then, a first tile "P1" is placed on the cement. Then, the base 10 is placed on the cement, with a first side of the base 10 being inserted between the first tile "P1" and the cement. Then, a second tile "P2" is placed on the cement, with a second side of the base 10 being sandwiched between the second tile "P2" and the cement. In such a manner, the second tile "P2" is juxtaposed to the first tile "P1". Then, the leveling member 20 is mounted on the adjusting plate 11, with the top end 12 of the adjusting plate 11 passing through the through hole 23 of the leveling member 20, and with the oneway ratchet toothed portion 24 of the leveling member 20 meshing with the oneway toothed rack 13 of the adjusting plate 11. Then, a pair of pulling pliers are placed on the operation face 21 of the leveling member 20 and clamps the adjusting plate 11. Then, the pulling pliers are operated successively to pull the adjusting plate 11 and to push the operation face 21 of the leveling member 20 so as to move the leveling member 20 downward as indicated by arrows "L1" shown in FIG. 2, so that the leveling member 20 is moved toward the base 10 until the abutting face 22 of the leveling member 20 abuts the first tile "P1" and the second tile "P2". At this time, the oneway ratchet toothed portion 24 of the leveling member 20 meshes with the oneway toothed rack 13 of the adjusting plate 11 to prevent the leveling member 20 from being moved upward. Thus, the first tile "P1" and the second tile "P2" are pressed and leveled by the abutting face 22 of the leveling member 20. After the cement is dried, the operator can kick or strike the leveling member 20, to break the breaking point 14, and to detach the adjusting plate 11 from the base 10, so that the leveling member 20 and the adjusting plate 11 are removed from the first tile "P1" and the second tile "P2". However, the operator has to operate the leveling member 20 by aid of a hand tool, thereby causing inconvenience to the operator when operating the conventional tile leveling structure. In addition, the operator needs to carry the hand tool for operating the conventional tile leveling structure, thereby causing a burden to the operator. Further, when the pulling pliers are operated to pull the adjusting plate 11 and to push the leveling member 20, the force is applied to and tolerated by the breaking point 14, so that the breaking point 14 is easily broken during operation of the pulling pliers.

BRIEF SUMMARY OF THE INVENTION

In accordance with the present invention, there is provided a tile leveling structure comprising a fixture and a leveling member mounted on the fixture. The fixture includes a base, an adjusting plate integrally formed on and extending upward from the base, and a oneway toothed rack mounted on the adjusting plate and located adjacent to a top end of the adjusting plate. The base and the adjusting plate of the fixture have a connection formed with a breaking point. The leveling member is provided with a passage, and the adjusting plate of the fixture passes through the passage of the leveling member. The passage extends longitudinally through a whole length of the leveling member. The leveling member has a bottom provided with a pressing face which has a first side provided with a first locking portion and a second side provided with a second locking portion. The leveling member has a first side provided with a first wing and a second side provided with a second wing. The first wing of the leveling member has a bottom end provided with a first hook which has a bottom provided with a first abutting face. The second wing of the leveling member has a bottom end provided with a second hook which has a bottom provided with a second abutting face.

According to the primary advantage of the present invention, the leveling member is moved downward along the adjusting plate of the fixture to rest on the first tile and the second tile, while the first wing and the second wing are pressed to move the first abutting face and the second abutting face to press the first tile and the second tile so as to level the first tile and the second tile, so that the fixture and the leveling member of the tile leveling structure are operated easily and conveniently.

According to another advantage of the present invention, the operator only needs to press the first wing and the second wing so as to level the first tile and the second tile, so that the tile leveling structure is operated by a manual labor without needing aid of any tool, thereby facilitating the operator leveling the tiles.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
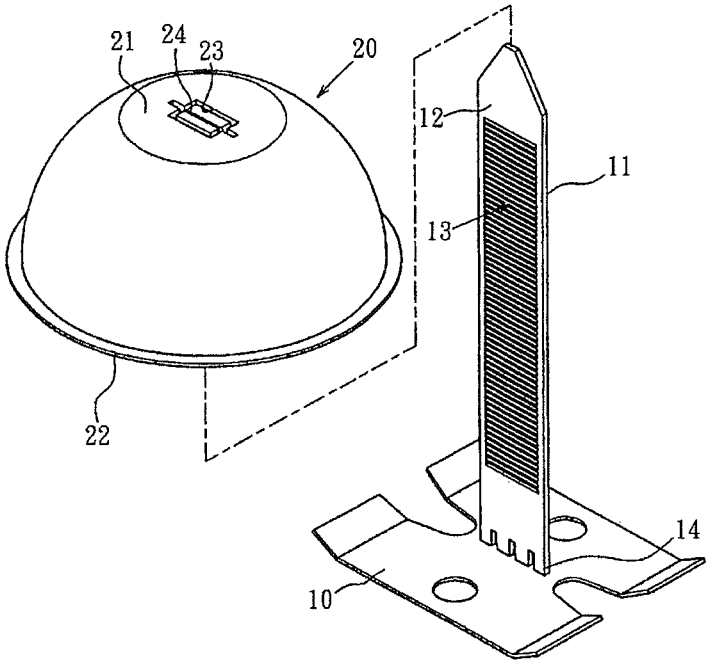
FIG. 1 PRIOR ART
FIG. 1 is an exploded perspective view of a conventional tile leveling structure in accordance with the prior art.
Figure 2:
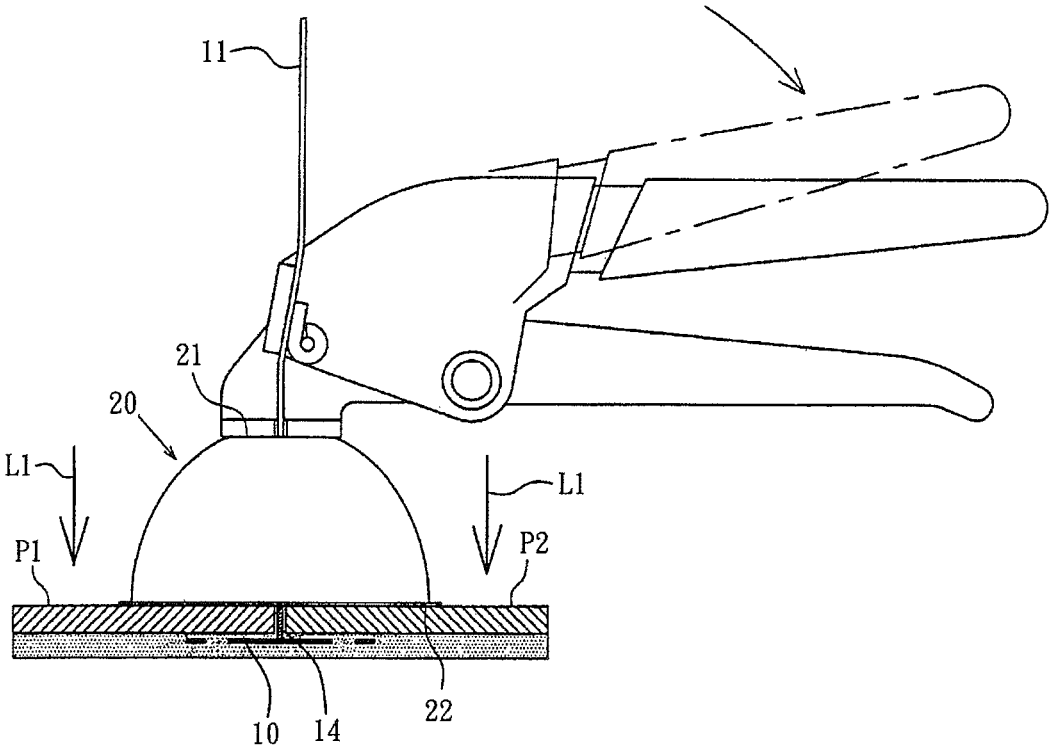
FIG. 2 PRIOR ART
FIG. 2 is a cross-sectional assembly view showing the conventional tile leveling structure being used for leveling a first tile and a second tile.
Figure 3:
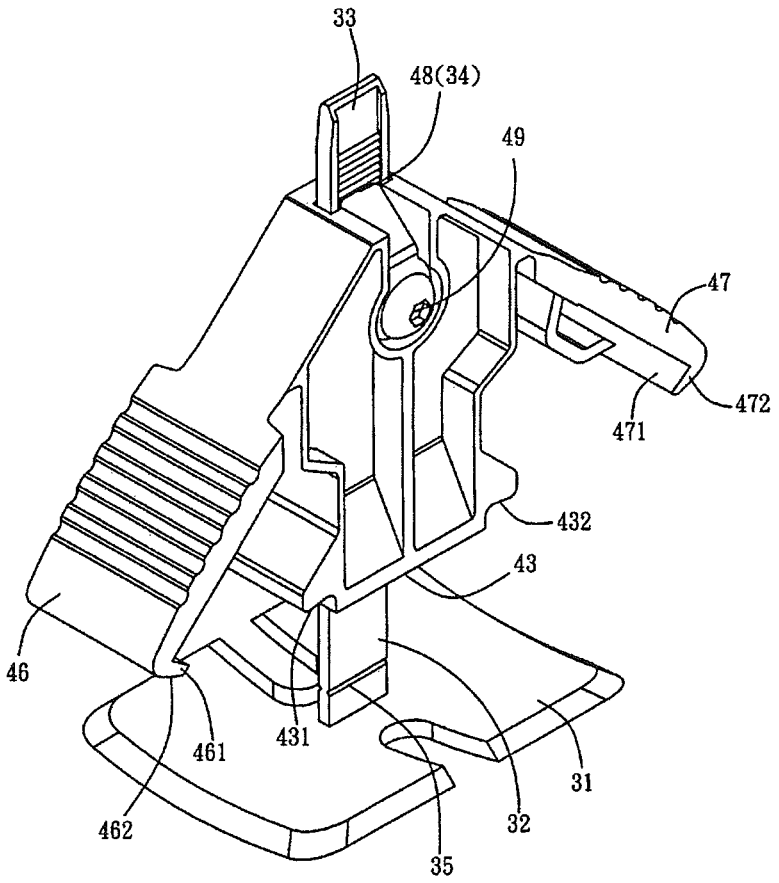
FIG. 3 is a perspective view of a tile leveling structure in accordance with the preferred embodiment of the present invention.
Figure 4:
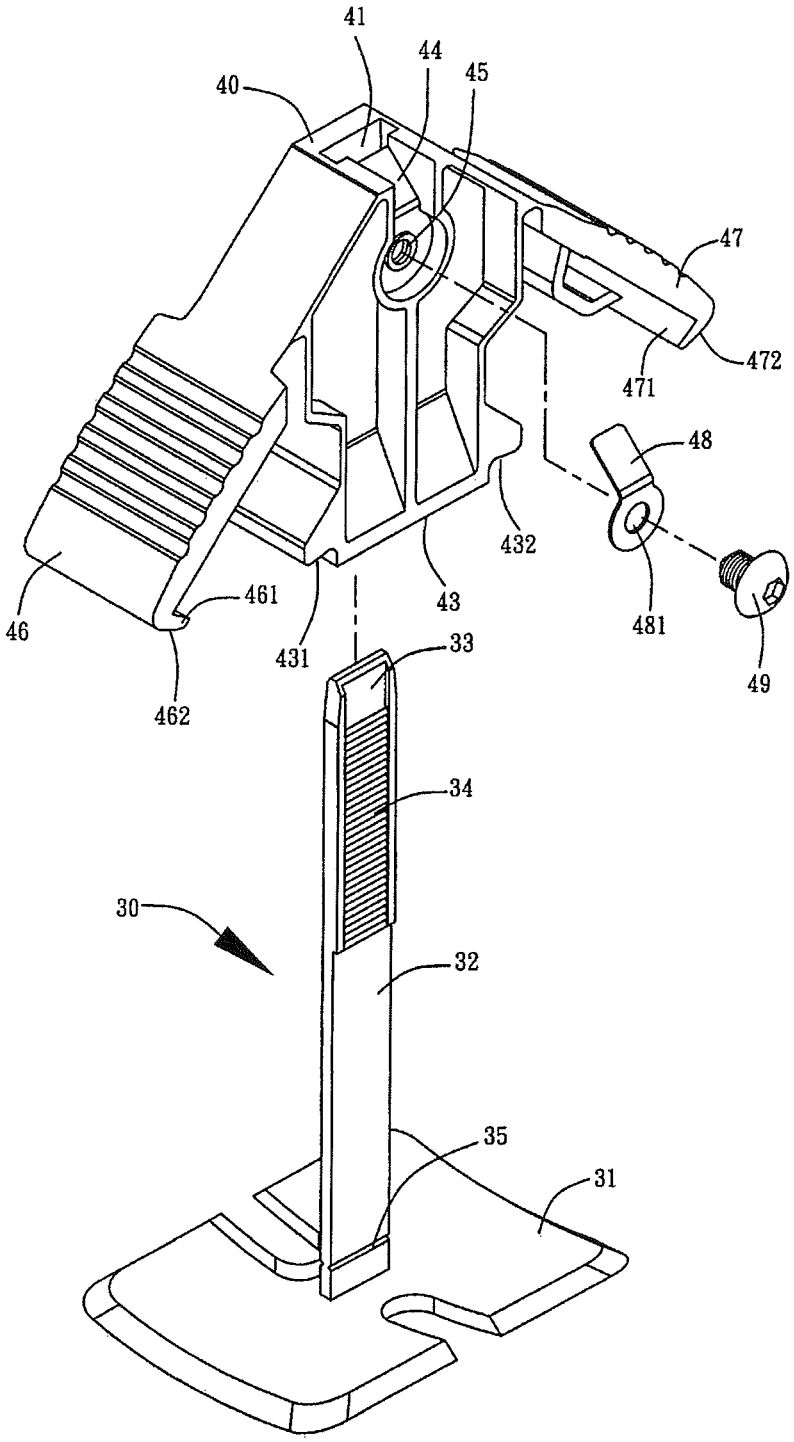
FIG. 4 is an exploded perspective view of the tile leveling structure in accordance with the preferred embodiment of the present invention.
Figure 5:
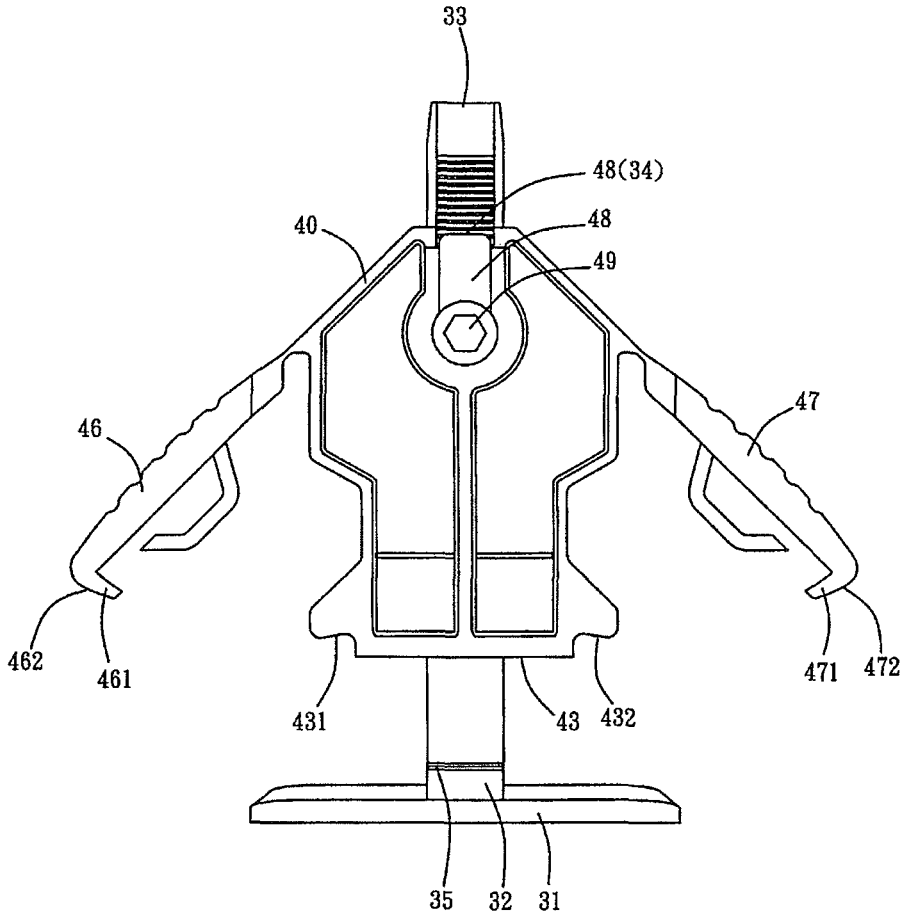
FIG. 5 is a front view of the tile leveling structure as shown in FIG. 3.
Figure 6:
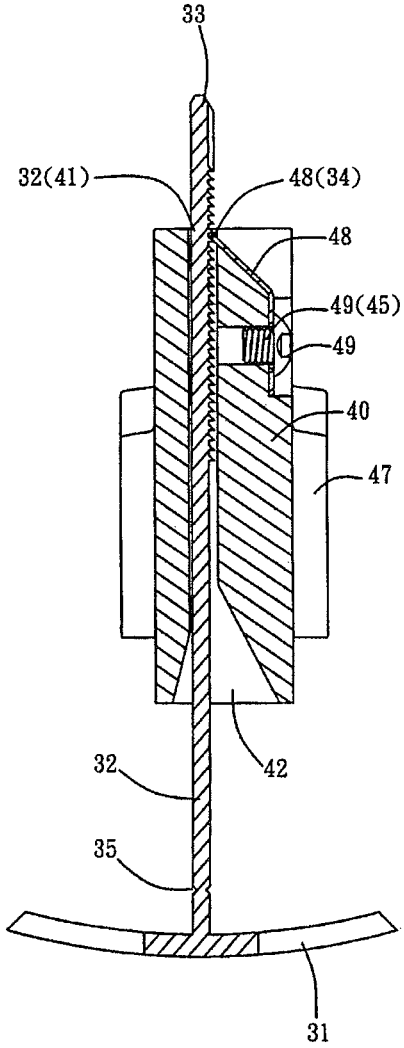
FIG. 6 is a side cross-sectional view of the tile leveling structure as shown in FIG. 3.

Referring to the drawings and initially to FIGS. 3-6, a tile leveling structure in accordance with the preferred embodiment of the present invention comprises a fixture 30 and a leveling member 40 mounted on the fixture 30.

The fixture 30 includes a base 31, an adjusting plate 32 integrally formed on and extending upward from the base 31, and a oneway toothed rack 34 mounted on the adjusting plate 32 and located adjacent to a top end 33 of the adjusting plate 32. The base 31 and the adjusting plate 32 of the fixture 30 have a connection formed with a breaking point 35.

The leveling member 40 is provided with a passage 41, and the adjusting plate 32 of the fixture 30 passes through the passage 41 of the leveling member 40. The passage 41 extends longitudinally through a whole length of the leveling member 40. The leveling member 40 has a bottom provided with a pressing face 43 which has a first side provided with a first locking portion 431 and a second side provided with a second locking portion 432. The leveling member 40 has a first side provided with a first wing 46 and a second side provided with a second wing 47. The first wing 46 of the leveling member 40 has a bottom end provided with a first hook 461 which has a bottom provided with a first abutting face 462. The second wing 47 of the leveling member 40 has a bottom end provided with a second hook 471 which has a bottom provided with a second abutting face 472.

In the preferred embodiment of the present invention, the passage 41 of the leveling member 40 has a bottom provided with a guiding groove 42 which guides entrance of the adjusting plate 32 of the fixture 30 through a bottom of the pressing face 43 into the passage 41.

In the preferred embodiment of the present invention, the first locking portion 431 is gradually tapered and inclined from the first side of the leveling member 40 toward the guiding groove 42, and the second locking portion 432 is gradually tapered and inclined from the second side of the leveling member 40 toward the guiding groove 42.

In the preferred embodiment of the present invention, the tile leveling structure further comprises a limit strip 48 secured on the leveling member 40 by a screw member 49. The leveling member 40 has an upper end provided with a support portion 44 and a screw hole 45. The support portion 44 of the leveling member 40 is located above the screw hole 45. The limit strip 48 rests on the support portion 44 of the leveling member 40 and meshes with the oneway toothed rack 34 of the fixture 30. The limit strip 48 is provided with a through hole 481. The screw member 49 extends through the through hole 481 of the limit strip 48 and is screwed into the screw hole 45 of the leveling member 40. In practice, the limit strip 48 meshes with the oneway toothed rack 34 of the fixture 30, so that the oneway toothed rack 34 of the fixture 30 only allows the leveling member 40 to move downward, and prohibit the leveling member 40 to move upward.

Figure 7:
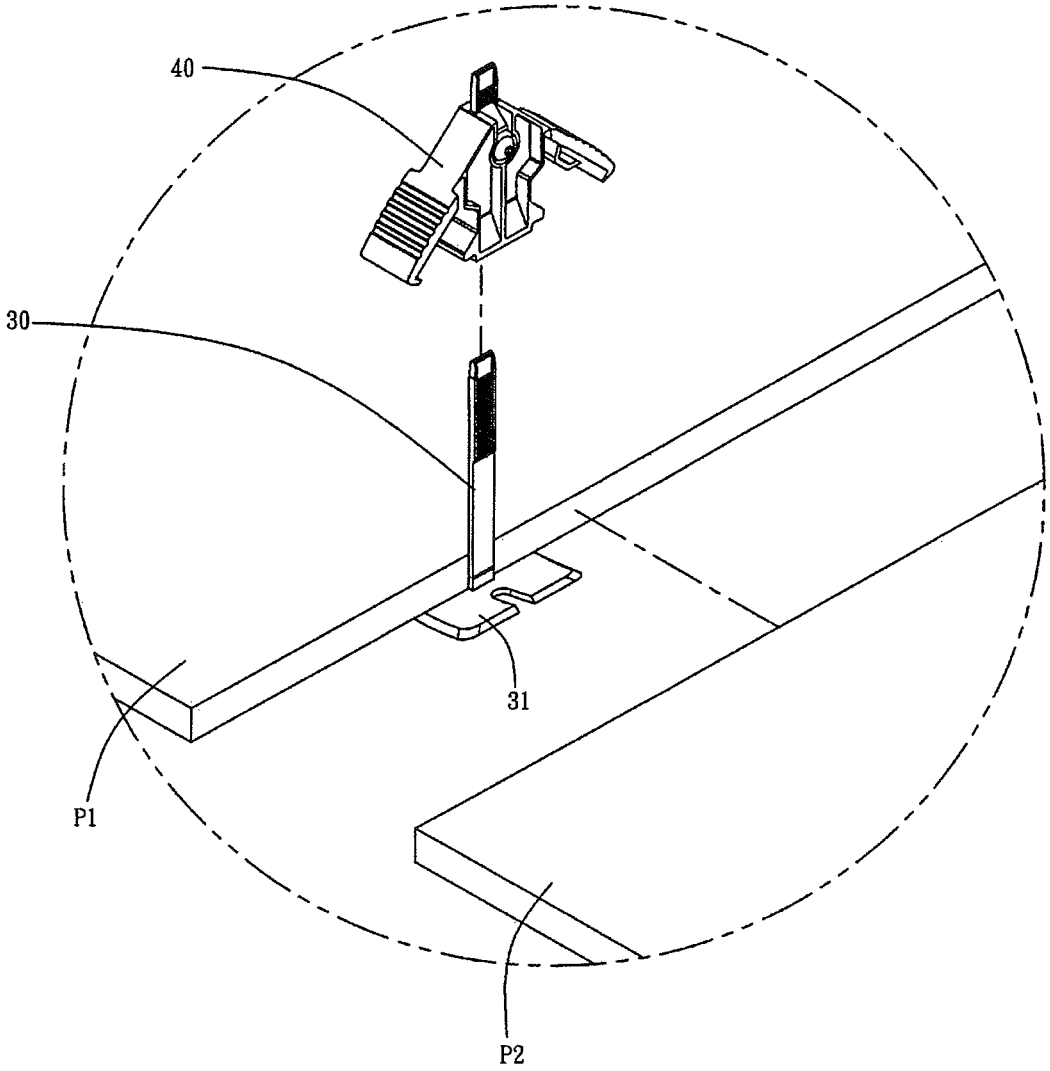
FIG. 7 is a perspective view showing the tile leveling structure for leveling a first tile and a second tile.
Figure 8:
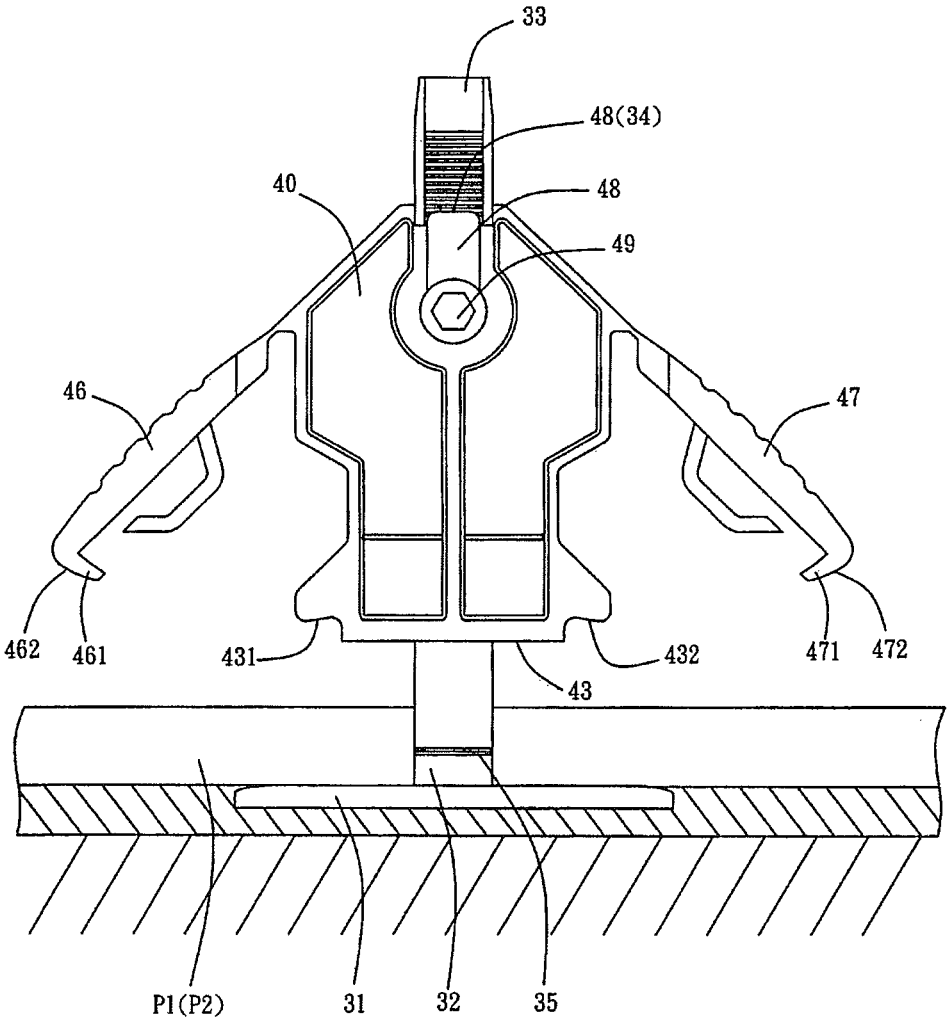
FIG. 8 is a cross-sectional view showing the tile leveling structure for leveling the first tile and the second tile.
Figure 9:
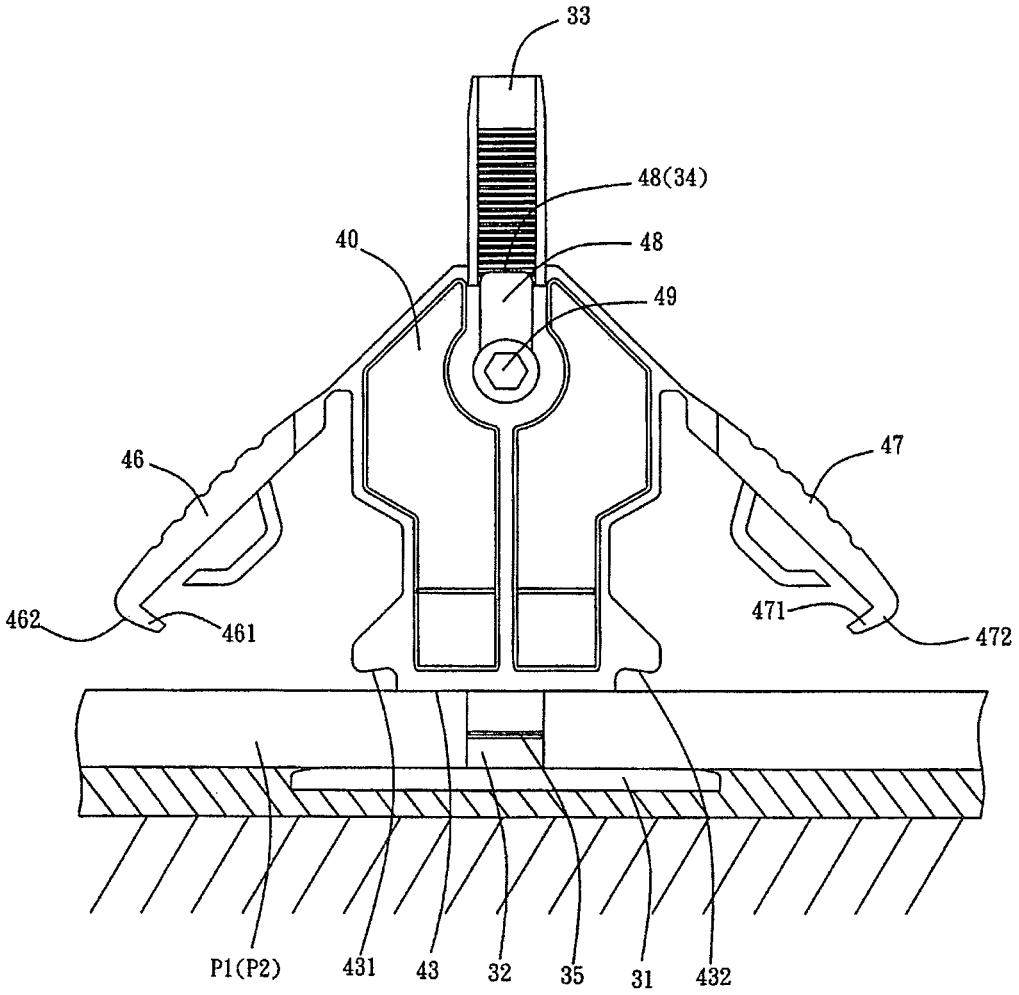
FIG. 9 is a schematic operational view of the tile leveling structure as shown in FIG. 8.
Figure 10:
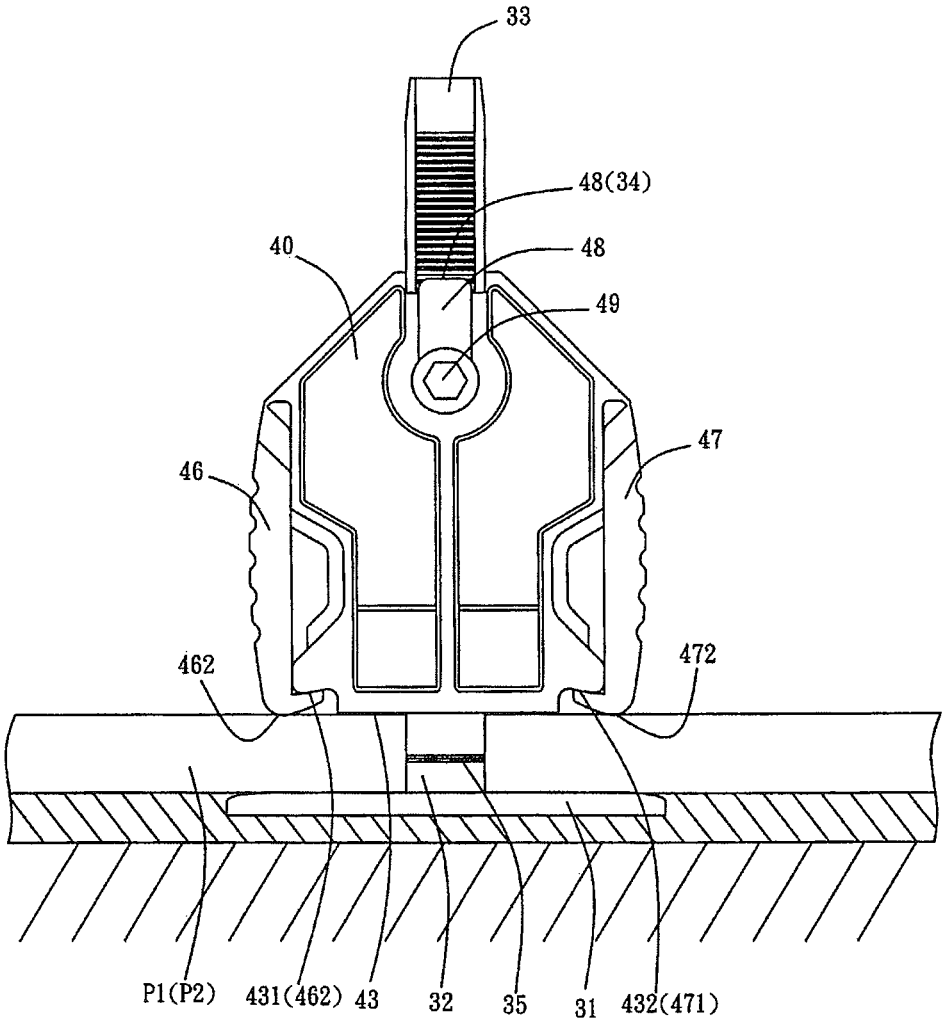
FIG. 10 is a schematic operational view of the tile leveling structure as shown in FIG. 9.

In operation, referring to FIGS. 7-10 with reference to FIGS. 3-6, cement is applied on the ground. Then, a first tile "P1" is placed on the cement. Then, the base 31 of the fixture 30 is placed on the cement, with a first side of the base 31 being inserted between the first tile "P1" and the cement as shown in FIG. 7. Then, a second tile "P2" is placed on the cement, with a second side of the base 31 being sandwiched between the second tile "P2" and the cement. In such a manner, the second tile "P2" is juxtaposed to the first tile "P1". Then, the leveling member 40 is mounted on the adjusting plate 32 of the fixture 30. At this time, the top end 33 of the adjusting plate 32 is guided by the guiding groove 42 to pass through the pressing face 43 into the passage 41. Thus, the leveling member 40 is moved downward along the adjusting plate 32 of the fixture 30 toward the first tile "P1" and the second tile "P2" as shown in FIG. 8 until the pressing face 43 of the leveling member 40 abuts the first tile "P1" and the second tile "P2" as shown in FIG. 9. At this time, the limit strip 48 meshes with and interlocks the oneway toothed rack 34 of the fixture 30, and the upward movement the leveling member 40 is blocked by the oneway toothed rack 34 of the fixture 30, so that the leveling member 40 is locked on the adjusting plate 32 of the fixture 30, and the first tile "P1" and the second tile "P2" are pressed by the pressing face 43 of the leveling member 40. Then, the first wing 46 and the second wing 47 are moved toward the pressing face 43 respectively. When the first hook 461 of the first wing 46 is moved to lock the first locking portion 431, and the second hook 471 of the second wing 47 is moved to lock the second locking portion 432 as shown in FIG. 10, the first abutting face 462 of the first wing 46 and the second abutting face 472 of the second wing 47 have a height slightly higher than that of the pressing face 43, so that the first abutting face 462 of the first wing 46 and the second abutting face 472 of the second wing 47 press the first tile "P1" and the second tile "P2" tightly and closely so as to level the first tile "P1" and the second tile "P2" exactly.

After the cement is dried, the operator can kick or strike the leveling member 40, to break the breaking point 35 of the adjusting plate 32, and to detach the adjusting plate 32 from the base 31, so that the leveling member 40 and the adjusting plate 32 are removed from the first tile "P1" and the second tile "P2", with the base 31 being located beneath the first tile "P1" and the second tile "P2". Then, the top end 33 of the adjusting plate 32 is pulled by the operator to remove the adjusting plate 32 from the leveling member 40, so that the leveling member 40 can be reused.

Accordingly, the leveling member 40 is moved downward along the adjusting plate 32 of the fixture 30 to rest on the first tile "P1" and the second tile "P2", while the first wing 46 and the second wing 47 are pressed to move the first abutting face 462 and the second abutting face 472 to press the first tile "P1" and the second tile "P2" so as to level the first tile "P1" and the second tile "P2", so that the fixture 30 and the leveling member 40 of the tile leveling structure are operated easily and conveniently. In addition, the operator only needs to press the first wing 46 and the second wing 47 so as to level the first tile "P1" and the second tile "P2", so that the tile leveling structure is operated by a manual labor without needing aid of any tool, thereby facilitating the operator leveling the tiles.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A tile leveling structure comprising:

a fixture including a base;

an adjusting plate integrally formed on and extending upward from the base; and a one way toothed rack mounted on the adjusting plate and located adjacent to a top end of the adjusting plate;

a leveling member mounted on the fixture and having a passage extending longitudinally through a whole length of the leveling member;

a bottom provided with a pressing face which has a first locking portion and a second locking portion; and a first side provided with a first wing and a second side provided with a second wing; and a limit strip secured on the leveling member by a screw member, wherein the base and the adjusting plate of the fixture have a connection formed with a breaking point;

the adjusting plate of the fixture passes through the passage of the leveling member;

the first wing of the leveling member has a bottom end provided with a first hook which has a bottom provided with a first abutting face;

the second wing of the leveling member has a bottom end provided with a second hook which has a bottom provided with a second abutting face;

the leveling member has an upper end provided with a support portion; and the limit strip rests on the support portion of the leveling member and meshes with the one way toothed rack of the fixture.

2. The tile leveling structure of claim 1, wherein the passage of the leveling member has a bottom provided with a guiding groove which guides entrance of the adjusting plate of the fixture through a bottom of the pressing face into the passage.

3. The tile leveling structure of claim 2, wherein the first locking portion is gradually tapered and inclined from the first side of the leveling member toward the guiding groove, and the second locking portion is gradually tapered and inclined from the second side of the leveling member toward the guiding groove.

4. The tile leveling structure of claim 1, wherein the leveling member is provided with a screw hole, the limit strip is provided with a through hole, and the screw member extends through the through hole of the limit strip and is screwed into the screw hole of the leveling member.

5. A tile leveling structure comprising:

a fixture including a base;

an adjusting plate integrally formed on and extending upward from the base; and a one way toothed rack mounted on the adjusting plate and located adjacent to a top end of the adjusting plate; and a leveling member mounted on the fixture and having a passage extending longitudinally through a whole length of the leveling member;

a bottom provided with a pressing face which has a first locking portion and a second locking portion; and a first side provided with a first wing and a second side provided with a second wing, wherein the base and the adjusting plate of the fixture have a connection formed with a breaking point;

the adjusting plate of the fixture passes through the passage of the leveling member;

the first wing of the leveling member has a bottom end provided with a first hook which has a bottom provided with a first abutting face;

the second wing of the leveling member has a bottom end provided with a second hook which has a bottom provided with a second abutting face; and when the first hook of the first wing is moved to lock the first locking portion, and the second hook of the second wing is moved to lock the second locking portion, the first abutting face of the first wing and the second abutting face of the second wing have a height slightly higher than that of the pressing face.

* * * * *